US005295899A

United States Patent [19]

Adams et al.

[11] Patent Number: 5,295,899

[45] Date of Patent: Mar. 22, 1994

[54] TWO DISC COIN HANDLING APPARATUS

[76] Inventors: Thomas P. Adams, 7524 Thomas Dr., Oconomowoc, Wis. 53066; Joseph P. Hanus, 213 West St., Johnson Creek, Wis. 53186; John H. Winkelman, W253 S4340 Meadowview Dr., Waukesha, Wis. 53186

[21] Appl. No.: 845,122

[22] Filed: Mar. 3, 1992

[51] Int. Cl.[5] ..... G07D 3/16

[52] U.S. Cl. ..... 453/10; 453/12

[58] Field of Search ..... 453/10, 12, 31, 32, 453/57, 4

[56] References Cited

U.S. PATENT DOCUMENTS

| | | | |
|---|---|---|---|
| 454,653 | 6/1891 | Kirkmeyer . | |
| 2,101,513 | 12/1937 | Samuelsen et al. . | |
| 3,726,290 | 4/1973 | Zimmerman | 453/11 |
| 3,771,538 | 11/1973 | Reis | 453/12 |
| 4,072,156 | 2/1978 | Abe . | |
| 4,271,855 | 6/1981 | Ueda . | |
| 4,531,531 | 7/1985 | Johnson | 453/31 X |
| 4,657,035 | 4/1987 | Zimmermann . | |

FOREIGN PATENT DOCUMENTS

| | | | |
|---|---|---|---|
| 1909087 | 8/1970 | Fed. Rep. of Germany . | |
| 2829285 | 2/1979 | Fed. Rep. of Germany | 453/12 |
| 2838746 | 3/1980 | Fed. Rep. of Germany . | |
| 3830674 | 3/1990 | Fed. Rep. of Germany | 453/12 |
| 62-112781 | 7/1987 | Japan . | |
| 1077852 | 8/1967 | United Kingdom | 453/32 |

*Primary Examiner*—F. J. Bartuska

[57] ABSTRACT

The coin sorter includes a rotating hard disc forming the bottom of a hopper, and a stationary sorter plate to one side of the hard disc. The sorter plate includes a circular sorting track that begins at a point adjacent to the perimeter of the hard disc and which includes a series of spaced sorting openings each sized for a particular coin denomination. The track has an edge defined by a thin resilient rail held in place in a groove by an elastomer band. A second rotating disc having a series of resilient fingers depending from its underside is mounted above and in close proximity to the upper surface of the sorter plate. The fingers partially overlap the upper surface of the hard disc. Coins deposited in the hopper are formed into a single file and single layer at the outer edge a central upright portion of the hard disc. The single file of coins is carried by the flexible fingers from the hard disc to the sorting track where the coins are sorted by size and counted as they pass through the sorting openings.

10 Claims, 5 Drawing Sheets

FIG. 1
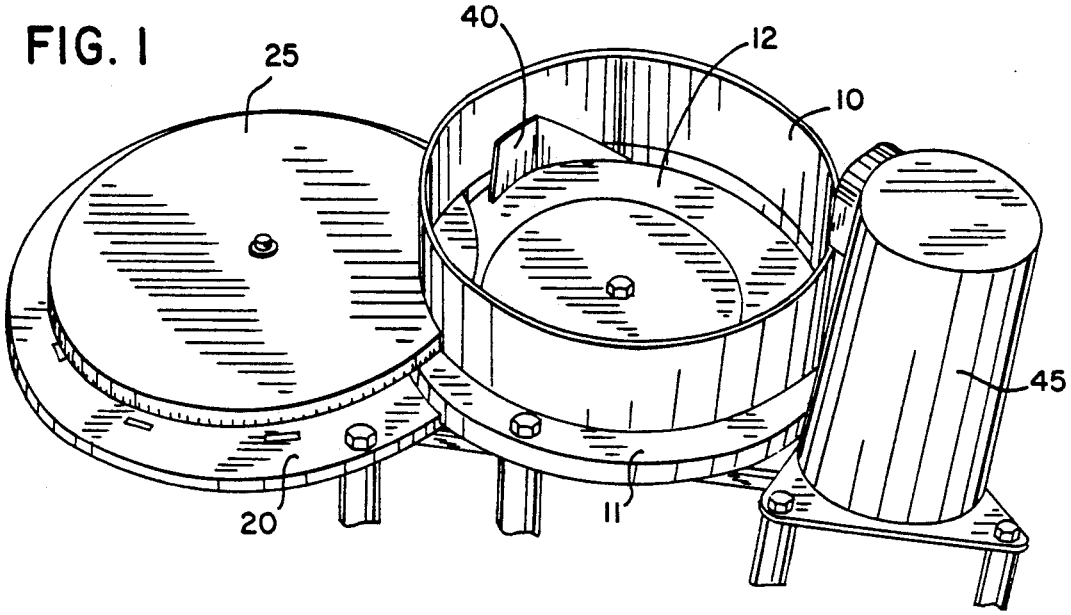
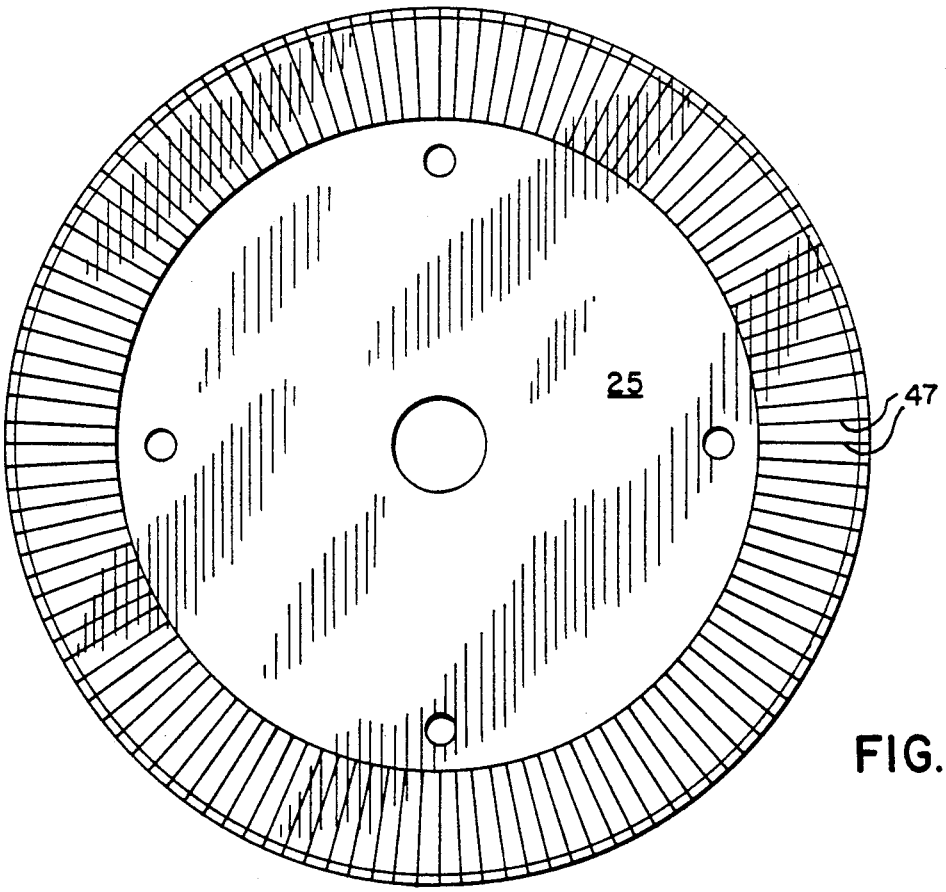
FIG. 4

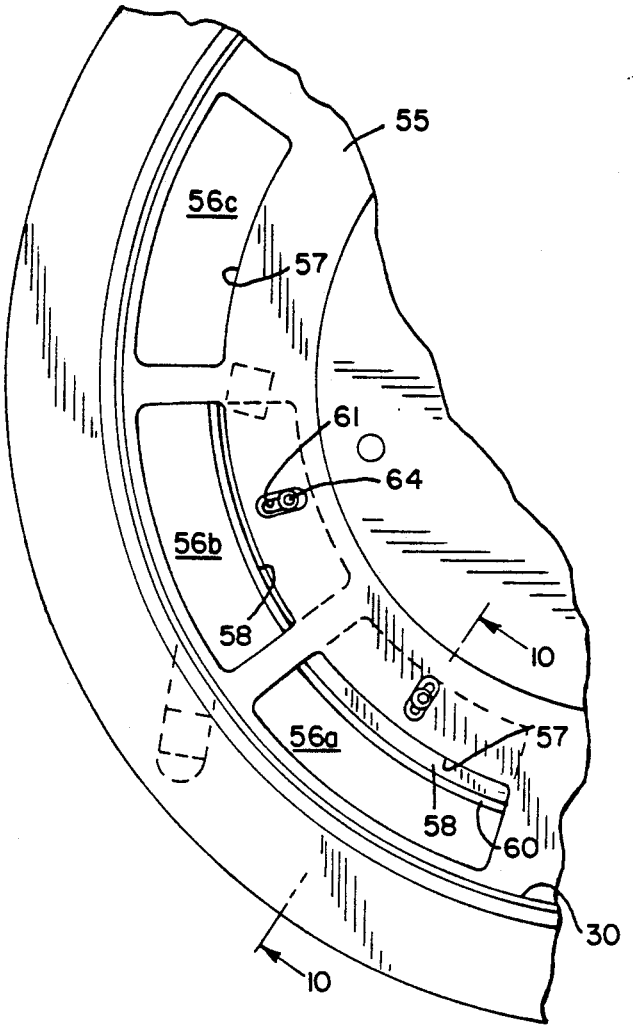
FIG. 9
FIG. 10
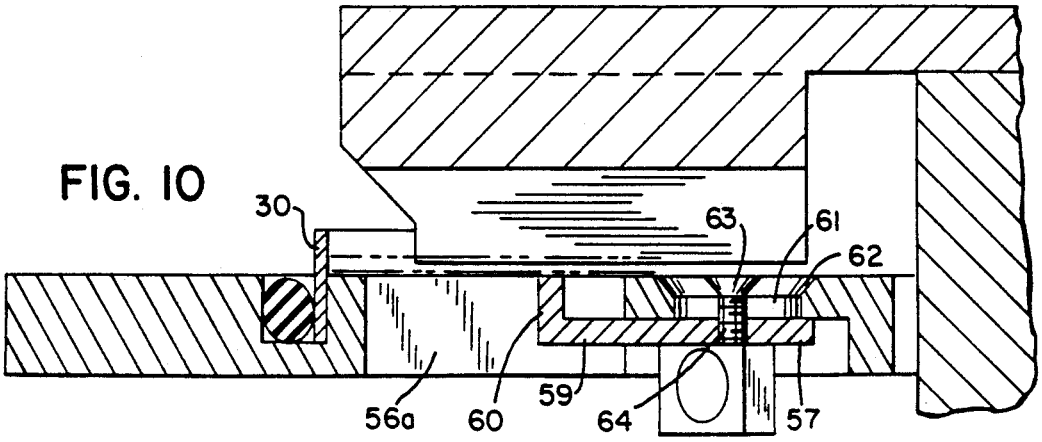

TWO DISC COIN HANDLING APPARATUS

BACKGROUND OF INVENTION

This invention relates to the handling of mixed denominations of coins, and particularly to an improved coin sorter that is simple in construction and operation.

A common form of coin sorter is the rail sorter in which coins of mixed denominations are fed in a single file and in a single layer to the entrance to a track defined on one side by a rail against which the coins are referenced. The coins in the single file move along the track and past openings of increasing size. The openings are sized for each of the respective diameters of the coins in the mix. As the coins move past an opening, coins of the size of that opening will pass through the opening and drop into a chute that leads to a point of collection. The coins are counted by sensors either as they move along the track or as they move through the openings.

A rail sorter can be designed to distinguish between coins whose diameters differ by only a slight amount. As a result, a rail sorter is very useful in dealing with coinage in which the diameters of different denominations are close to each other and also for coinage in which there are a large number of different sizes of coins.

In the simplest form of a rail sorter, the coins are moved along the track under the effect of gravity. An example of this simple form is shown in U.S. Pat. No. 454,653 issued Jun. 23, 1891 to Kirkmeyer. The use of gravity requires that the track be inclined. Where a horizontal track is desired or where a greater speed of coin processing is desired, the coins may be physically moved along the track usually by one or more driven endless belts. Examples of this form are shown in U.S. Pat. No. 4,072,156 issued Feb. 7, 1978 to Abe; U.S. Pat. No. 4,271,855 issued Jun. 9, 1981 to Ueda; and U.S. Pat. No. 4,657,035 issued Apr. 14, 1987 to Zimmermann. Driven endless belts have also been used in conjunction with inclined tracks as exemplified by U.S. Pat. No. 2,101,513 issued Dec. 7, 1937 to Samuelsen, et al.

A variation of the rail sorter arranges the track in a circle rather than in a straight line. An example of this variation is found in U.S. Pat. No. 3,771,538 issued Nov. 13, 1973 to Reis. In the Reis patent, coins are deposited on the top surface of a rotating hard disc that forms the bottom of a hopper. The coins are moved by centrifical force through an opening in a wall of the hopper to align the coins in a single file and in a single layer at the circumference of the rotating hard disc. The single file of coins passes through a tangential passage to a sorter plate which includes the track at the outer periphery of the plate. The rail of the track is formed by a rim extending around the track. Above the sorter plate is a second rotating disc. The second disc has a resilient rubber ring on its underside that grasps the coins moving in from the tangential passage and carries the coins around the sorting track and past the track openings.

A coin sorter in accordance with the present invention also has a hard rotating disc on which coins are deposited and an adjacent sorter plate with a circular track and with an overlying rotating disc having a resilient underside. However, in the present invention the rotating hard disc and the rotating resilient disc overlap so that coins are handed off from the hard disc to the resilient disc. The result is a coin sorter that can operate at a relatively high speed without jamming and with accuracy in sorting.

The apparatus of the present invention can also be used to sort one or more selected denominations of coins from a mix of coins to feed the selected coins to packaging mechanisms or other coin handling equipment.

SUMMARY OF THE INVENTION

It is a principal object of the invention to provide a fast, simple, and efficient mechanism for sorting mixed denomination coins.

It is also an object of the invention to provide a coin sorter which is relatively jam-free and in which any coin jamming can be easily rectified without damage to the sorting mechanism.

It is another object of the invention to provide a coin sorter in which wear parts are easily replaced.

It is a further object of the invention to provide a coin sorter in which a wide variety of denominations of coins can be handled.

The foregoing objects are achieved by a coin handling apparatus that includes a rotating disc having an upper surface upon which coins to be sorted are deposited, and a stationary sorter plate to one side of the rotating disc and having a generally circular sorting track that begins at a point adjacent to the perimeter of the rotating disc. The track including a plurality of sorting stations. A second rotating disc having a resilient underside is disposed in close proximity to the upper surface of the sorter plate, and the resilient underside partially overlaps the upper surface of the first rotating disc to engage coins that are near the perimeter of the first rotating disc and to move the coins along the track.

A coin sorter in accordance with the invention preferably has the sorting stations defined by openings in the track with counting mechanisms in the forms of sensors disposed beneath each opening so that each coin passing through an opening is counted. The openings may each have a width that is unique to a particular denomination of coin to be sorted. Alternately, one or more openings may be unique to a particular denomination and other openings may be sized to remove coins that are smaller or larger. Still further, one or more of the openings may be adjustable in width. One side of the track is defined by an upstanding rim which is mounted in the sorting plate by cushioning means that allow the rim to give slightly upon impact by coins.

Preferably, the resilient underside of the second rotating disc is defined by a series of radially disposed and depending flexible fingers formed of rubber or other elastomeric material. The fingers each have a radially outer end with an inwardly tapered portion leading to an upright portion adjacent to the upper surface of the first disc and sorter plate.

The upright rim forms an outer reference edge or rail against which the coins are disposed as they move through the track. The rail extends at a slight inward spiral relative to the center of rotation of the resilient disc so that the coins will always tend to be forced against the rim by the flexible fingers which tend to move the coins in a circular direction.

The first disc preferably has a hard surface and defines the bottom of a hopper. The center of the hard disc includes a raised portion that has an outer edge spaced inwardly from the hopper and at a height that is less than twice the thickness of the thinnest coin to be handled. Preferably, a deflector plate extends over the upper surface of the rotating hard disc to a distance from the edge which is small enough so that two rows of the smallest diameter coins cannot pass therebetween.

Further in accordance with the invention, the two rotating discs may be driven by a single drive motor with a single belt. The hard disc and resilient disc are driven in opposite directions. The belt extends around a drum that mounts to the resilient disc and a run of the belt engages the perimeter of a flange on the hard disc.

In an alternate embodiment, drive rollers are mounted adjacent the perimeter of the hard disc at points where the hard disc intersects the perimeter of the sorter plate to assist in maintaining a single layer and single row of coins that are handed off to the rotating resilient disc, and to move coins quickly away from the hand-off area if the coins are not engaged by the resilient disc.

The forgoing and other objects and advantages of the invention will appear in the following detailed description. In the description, reference is made to the accompanying drawings which illustrate preferred embodiments of the invention.

BRIEF DESCRIPTION OF THE DRAWINGS

FIG. 1 is a view in perspective of the operating elements of a coin sorter in accordance with the present invention;

FIG. 4 is a plan view of the underside of the rotating resilient disc;

FIG. 9 is a partial plan view of an alternative mechanism that has adjustable openings in a track and that is arranged for selecting one denomination of coin from a mix of coins; and FIG. 10 is a partial view in vertical section and taken in the plane of the line 10—10 of FIG. 9.

DETAILED DESCRIPTION OF THE PREFERRED EMBODIMENTS

Figure 2:
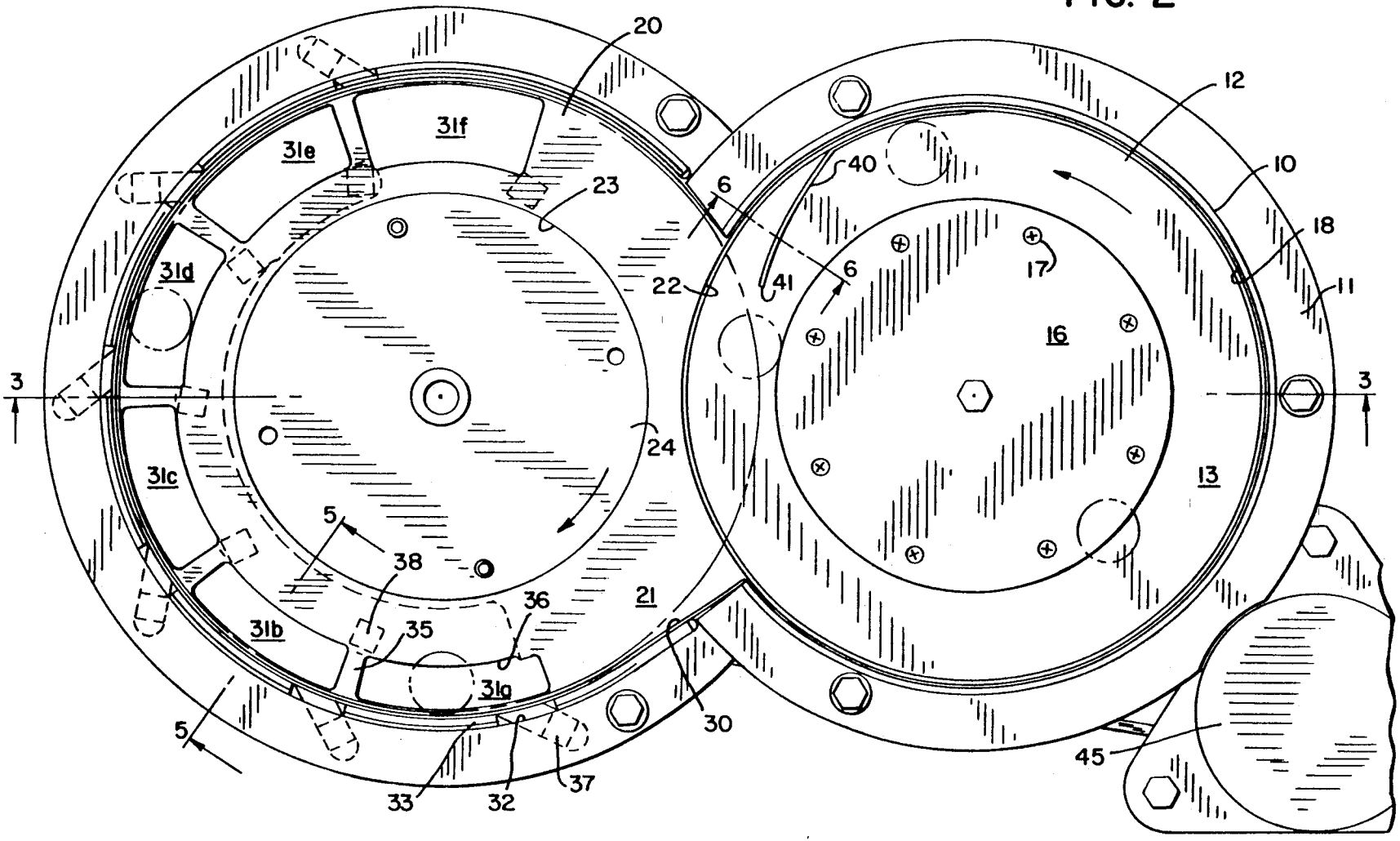
FIG. 2 is a top plan view of the sorter of FIG. 1 with the rotating resilient disc removed for purposes of illustration.

Referring to the first embodiment, the coin sorter includes an upright circular cylindrical hopper 10 which is mounted to the top of a ring 11. A first disc 12 is mounted within the ring 11 and has a hard, generally flat upper surface 13 of metal and a depending circular flange 14. The hard disc 12 is attached at its center to rotate with a shaft 15 that is journaled in bearings (not shown).

Figure 3:
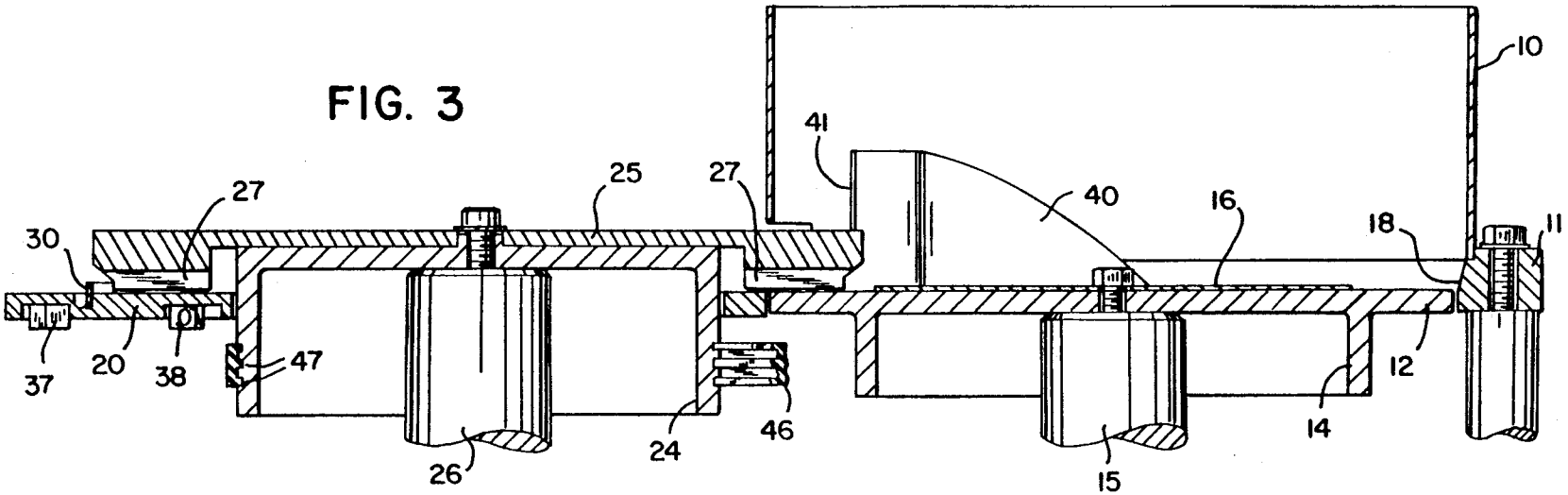
FIG. 3 is a view in vertical section taken in the plane of the line 3—3 of FIG. 2.
Figure 6:
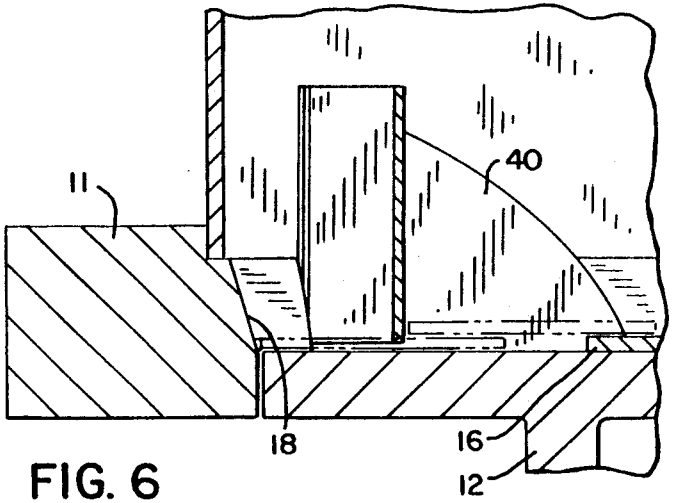
FIG. 6 is a partial view in vertical section and to an enlarged scale and taken in the plane of the line 6—6 of FIG. 2.

A plug 16 is mounted on the upper surface 13 of the hard disc 12 to form a raised portion. The plug 16 is in the form of a flat plate secured to the upper surface 13 by counter-sunk screws 17. The thickness of the plug 16 is less than twice the thickness of the thinnest coin to be handled by the coin sorter. The perimeter edge of the plug 16 is preferably serrated or otherwise roughened. As shown in FIG. 3, the ring 11 has an inwardly tapered surface 18 extending from the bottom of the hopper 10 towards the perimeter of the hard disc 12 which is closely spaced to the ring 11.

A sorter plate 20 is disposed adjacent to the hard disc 12 with its upper surface 21 in substantially the same plane as the upper surface 13 of the hard disc. The sorting plate 20 is essentially circular except that it has a cutout 22 in its periphery to accommodate the circular perimeter of the hard disc 12, as shown particularly in FIG. 2. The center of the sorter plate has a circular opening 23 to accommodate a drum 24 that mounts a second rotating disc 25. Both the drum 24 and disc 25 are attached to the top of a shaft 26 that is journaled in bearings (not shown). The underside of the second disc 25 adjacent its perimeter mounts a plurality of radially disposed and circumferentially spaced fingers 27. The fingers 27 are each formed of a rubber or other elastomeric material. A preferred material is a polyurethane having a Shore A hardness of about 75. As shown particularly in FIG. 5, each finger 27 extends down to near the top surface 21 of the sorter plate 20. Each finger has a radially outer profile formed with an upright portion 28 adjacent to the sorter plate surface 21 and an outwardly inclined portion 29 above the upright portion 28. Because of the center to center spacings of the two rotating discs 12 and 25, the fingers 27 will sweep over a portion of the upper surface 13 of the hard disc 12 where the perimeters of the two discs overlap (see FIG. 2). The sides of the hopper 10 and the ring 11 are opened to accept the extending perimeter of the resilient disc 25.

Figure 5:
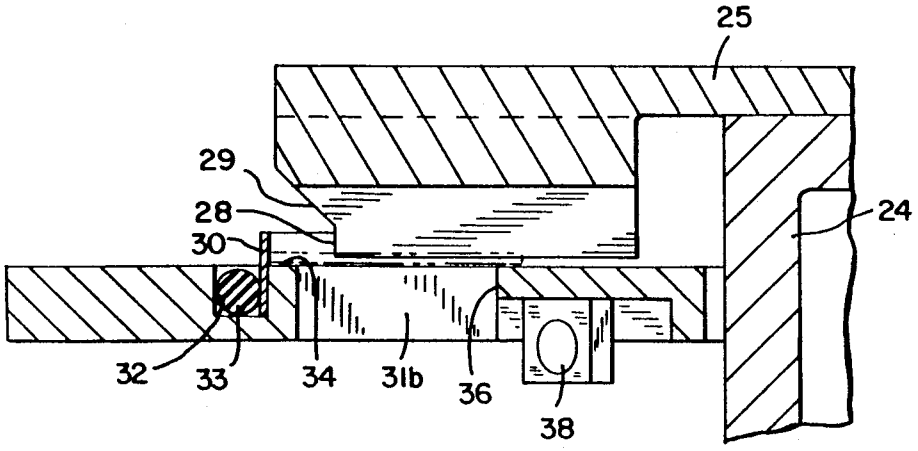
FIG. 5 is a partial view in vertical section and to an enlarged scale taken in the plane of the line 5—5 of FIG. 2.

The sorter plate 20 includes a sorting track defined by an upright circumferential rim 30 and a series of openings 31*a*, 31*b*, 31*c*, 31*d*, 31*e*, and 31*f*. The rim 30 begins at a point near the edge of the hard disc 12 and extends beyond the last opening 31*f*. The rim is received in a groove 32 in the sorter plate 20, and is held in place within the groove by a flexible rubber or elastomeric member 33, as best seen in FIG. 5. As shown in FIG. 2, each of the openings 31 is of an increasing width compared to a preceding opening and the openings are separated by bridge portions 35 of the sorter plate 20. The openings 31 are dimensioned so that there is a small lip 34 defined between the radially outer edge of an opening 31 and the rim 30. The radially inward side 36 of an opening 31 is spaced from the rim 30 a distance that is just slightly greater than the diameter of a coin to be sorted at that particular opening. This is illustrated by the coin shown in phantom lines at opening 31*d* in FIG. 2. Also as shown in FIG. 2, each of the openings 31 extends for some distance along the rim 30. Each opening 31 has associated with it a light source in the form of a light emitting diode 37 and a photocell 38. The path of the light from each source 37 to a respective photocell 38 extends just beneath and along a major length of each opening 31 so that the passage of a coin through an opening 31 will break the beam of light and be registered on the photocell 38 thereby providing a signal for each sorted coin of a particular denomination. The signals are fed to counters that are well known to the art.

A flexible deflector plate 40 in the form of a thin metal strip extends from an inner surface of the hopper 10 and has its outer end 41 spaced from the edge of the plug 16 a distance that is less than twice the diameter of the smallest coin to be handled. As a result, only a single row of coins can pass between the end 41 of the deflector plate 40 and the edge of the plug 16.

Figure 7:
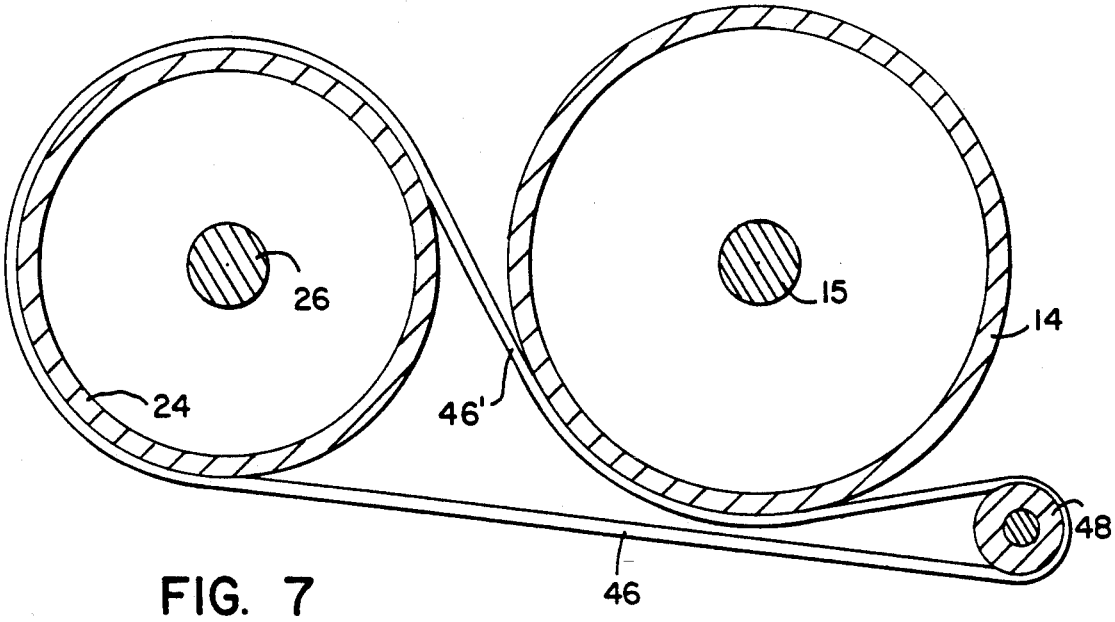
FIG. 7 is a view showing the drive for the mechanism.

The hard disc 12 and resilient disc 25 are preferably driven by a single electric motor 45 which drives a ribbed belt 46. As shown in FIG. 3, the outer perimeter of the drum 24 is provided with grooves 4 which receive the ribs of the belt 46. As shown in FIG. 7, the belt 46 extends from a drive pulley 48 connected to the motor shaft and around the outside of the drum 24 that mounts the resilient disc 25. A return run 46' of the belt 46 extends about a portion of the outer periphery of the circular flange 14 on the hard disc 12.

In operation, mixed coins are deposited in the hopper 10 and upon the rotating hard disc 12. The mechanism works best if a supply of coins is gradually fed to the hard disc 12. The coins on the hard disc 12 will tend to move by centrifical force to the outer edge of the disc 12 and against the ring 11. The inclined surface 18 on the ring will tend to prevent coins from standing on edge. Single layers of coins will tend to settle between the edge of the plug 16 and the ring 11. The counterclockwise rotating hard disc 12 will move the coins into engagement with the deflector plate 40 which ensures that only a single row of coins will pass its outer end 41. The coins passing the deflector plate 40 will be lying flat upon the upper surface 13 of the hard disc 12 outside of the plug 16. The fingers 27 on the underside of the resilient disc 25 will then engage the upper surface of such coins. The profile of the radial end of the fingers 27 allows coins to be moved beneath the fingers without undue abrasion or distortion of the fingers.

The coins are, in effect, handed off from the rotating hard disc 12 to the rotating resilient disc 25, which is turning at a greater speed. The coins are carried by the fingers 27 from the hard disc upper surface 13 to the upper surface 21 of the sorting plate 20. The coins will encounter the beginning of the upright rim 30 which will urge the coins radially inward as they are carried by the fingers 27 over the surface of the sorting plate 20. Preferably, the entire rim 30 is arranged as a slight spiral so that it encroaches gradually upon the center of rotation of the resilient disc 25 throughout its length. This will cause the coins to be urged tightly against the rim 30 as they are carried through the sorting track. A coin will be carried through the track with its opposite edges resting on the lip 34 and the sorter plate 20 until it encounters an opening 31 for its size. Each coin will be forced through its appropriate opening by reason of the resiliency of the fingers 27, aided by gravity. The passage of each coin through an opening 31 results in a count signal being generated.

Instead of using counting mechanisms at each opening 31, the coins could be counted by coin recognition sensors located at the start of the track before the first opening 31*a*. Such coin recognition sensors could take the form of proximity sensors or photocells arranged in a pattern to recognize the various denominations of coins as they pass into the beginning of the track.

The rim 30 is preferably formed of a strip of spring steel. The manner of mounting the rim 30 in a machined groove 32 provides for a reference edge that accurately locates the coins as they travel through the track. Should a jam of coins tend to occur along the track, the rim 30 can yield slightly and allow the jam to clear. The resiliency of the mounting for the rim 30 also assists in forcing coins back toward the track path.

A principal wear component in the mechanism is the resilient disc 25. It is readily accessible for replacement or repair. The hard disc 12 and plug 16, and the sorter plate 20 are other parts that can exhibit wear. They are all accessible from above and readily replaceable as needed.

Figure 8:
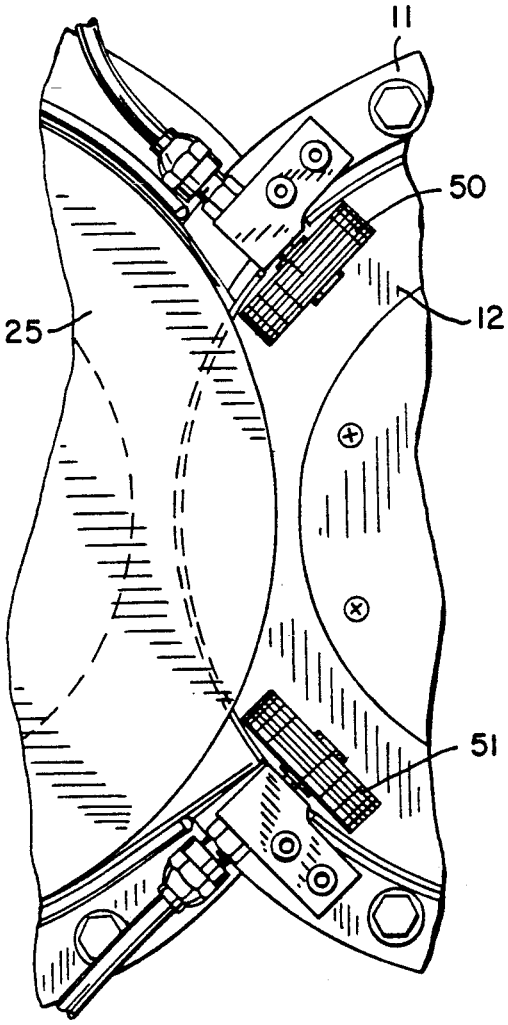
FIG. 8 is a partial plan view showing an alternative arrangement using drive rollers.

FIG. 8 shows an alternative embodiment in which the deflector plate 40 of the first embodiment is replaced by a driven wheel 50. The perimeter of the wheel 50 is spaced from the surface 13 of the hard disc 12 a distance that is less than the thickness of two of the thinnest coins to be sorted so as to prevent two layers of coins from reaching the area in which coins are handed off from the hard disc 12 to the resilient disc 25. The wheel 50 is driven in a direction counter to the direction of rotation of the hard disc and will also tend to prevent two rows of coins from entering the hand-off area at the same time. A similar driven wheel 51 may be mounted over the surface of the hard disc 12 beyond the hand-off area and rotated in the same direction as the hard disc 12 to quickly carry away from the hand-off area coins that have not been engaged by the fingers 27.

A mechanical brake (not shown) may be associated with the motor 45 to halt the driving of the two discs and stop the sorting of coins when the count of coins of a particular denomination reaches a predetermined level. Alternately, the motor 45 is a DC motor that is dynamically braked by a use of a suitable DC motor control.

FIGS. 8 and 9 show an alternative mechanism that is especially adapted for use with coin packaging equipment. The mechanism includes a sorter plate 55 that has three coin openings 56*a*, 56*b*, and 56*c*. The coin openings 56 are all identical in size. That is, they have the same width as measured from the rim 30 to an opposite edge 57 of each opening 56. The coin openings 56 also have the same length along the circumference of the track. The first two openings 56*a* and 56*b* each mount an adjustable ledge 58 which has a wedge portion 59 disposed along the underside of the sorter plate 55 and an upright lip portion 60 that is disposed within the opening 56*a* or 56*b*. An elongated radial slot 61 is provided in the sorter plate at a mid-point of an opening 56. The slot 61 has a chamfered upper edge 62 to receive conical head 63 of a bolt 64 that is threaded into the wedge portion 59. The lip 60 forms an adjustable opposite edge for the openings 56*a* or 56*b*.

The middle opening 56*b* can be adjusted in width so that it will sort off of the track a particular selected denomination of coin. The sorted coin, which can also be counted as it falls through the opening 56*b*, may be directed by a chute to a packaging mechanism for packaging that particular denomination into coin rolls or bags. The first opening 56*a* can be adjusted in width to off-sort all coins that are smaller in diameter than the selected denomination. The last opening 56*c* will off-sort all coins that are larger in diameter than the selected denomination of coin. In this manner, a single selected denomination of coin can be sorted from the mix of coins with smaller and larger coins being off-sorted.

The same mechanisms for adjusting the operating widths in the openings 56 in the track can be used for one or more of the openings 31 of the first embodiment. In such manner, a single mechanism can be designed to be adjustable to accept different mixes of coins found in different coin systems of various countries.

We claim:

1. A coin handling apparatus, comprising:

a first rotatable disc having an upper surface upon which coins may be deposited;

a stationary sorter plate to one side of the first rotatable disc and having a generally circular sorting track that begins at a point adjacent to the perimeter of the first rotatable disc, said track including a plurality of sorting stations, said track having an upper surface that is in the same plane as the upper surface of the first rotatable disc; and a second rotatable disc having a resilient underside disposed in close proximity to the upper surface of the sorter plate, said resilient underside being adapted to engage coins that are on the first rotatable disc and to move the coins along the track to the sorting stations.

2. A coin sorter, comprising:

a hopper;

a rotatable hard disc forming the bottom of the hopper;

a stationary sorter plate to one side of the rotatable disc and having a generally circular sorting track beginning at a point adjacent to the perimeter of the hard disc, said sorter plate having a top surface that forms an extension of the top surface of the hard disc and is in the same plane; and a rotatable resilient disc disposed above and opposing the top surface of the sorter plate and partially overlying the hard disc, the resilient disc being adapted to engage coins on the hard disc and to move the coins to and along the track.

3. A coin sorter in accordance with claim 2 wherein the sorting track includes an upright rail forming an outer reference edge against which coins are disposed as they are moved along the track and the rail comprises an upright ribbon of spring steel disposed in a cooperating groove on the outside of the track and held in place by cushioning means so that the rail will yield upon impact by coins.

4. A coin sorter in accordance with claim 2 together with a motor and a single belt connecting the motor shaft to both the hard disc and the resilient disc.

5. A coin sorter in accordance with claim 4 wherein the belt extends from the motor shaft and around a drum mounting the resilient disc, and a return run of the belt engages the perimeter of a circular flange connected to the hard disc.

6. A coin sorter, comprising:

a hopper:

a rotatable hard disc forming the bottom of the hopper;

a stationary sorter plate to one side of the rotatable disc and having a generally circular sorting track beginning at a point adjacent to the perimeter of the hard disc, said sorter plate having a top surface that forms an extension of the top surface of the hard disc; and a rotatable resilient disc disposed above and opposing the top surface of the sorter plate and partially overlying the hard disc, the resilient disc including an array of depending flexible fingers adapted to engage coins adjacent the perimeter of the hard disc and to move the coins to and along the track, the flexible fingers being spaced from each other adjacent the perimeter of the resilient disc and each finger extending in a radial direction from the center of the resilient disc.

7. A coin sorter in accordance with claim 6 wherein each finger has a radially outer end having an inwardly tapered portion leading to an upright portion adjacent to the top surfaces of the hard disc and sorter plate.

8. A coin sorter, comprising:

a hopper;

a rotatable hard disc forming the bottom of the hopper;

a stationary sorter plate to one side of the rotatable disc and having a generally circular sorting track beginning at a point adjacent to the perimeter of the hard disc, said sorter plate having a top surface that forms an extension of the top surface of the hard disc;

a rotatable resilient disc disposed above and opposing the top surface of the sorter plate and partially overlying the hard disc, the resilient disc being adapted to engage coins adjacent the perimeter of the hard disc and to move the coins to and along the track; and a driven roller disposed adjacent the perimeter of the hard disc before the overlap of the hard disc and the resilient disc, the roller having its perimeter spaced above the top surface of the hard disc a distance less than the thinnest coin to be sorted and being driven in a direction opposing the movement of the hard disc.

9. A coin sorter, comprising:

a hopper;

a rotatable hard disc forming the bottom of the hopper;

a stationary sorter plate to one side of the rotatable disc and having a generally circular sorting track beginning at a point adjacent to the perimeter of the hard disc, said sorter plate having a top surface that forms an extension of the top surface of the hard disc;

a rotatable resilient disc disposed above and opposing the top surface of the sorter plate and partially overlying the hard disc, the resilient disc being adapted to engage coins adjacent the perimeter of the hard disc and to move the coins to and along the track; and a driven roller disposed adjacent the perimeter of the hard disc and following the overlap of the hard disc and the resilient disc, the roller being driven in a direction that is the same as the movement of the hard disc.

10. A coin sorter, comprising:

a hopper;

a rotatable hard disc forming the bottom of the hopper, said hard disc having a central raised portion with a circular edge spaced inwardly from the inside of the hopper, said edge having a height that is less than twice the thickness of the thinnest coin to be sorted;

a stationary sorter plate to one side of the rotatable disc and having a generally circular sorting track beginning at a point adjacent to the perimeter of the hard disc, said sorter plate having a top surface that forms an extension of the top surface of the hard disc and extends through an opening in the hopper;

a rotatable resilient disc disposed above and opposing the top surface of the sorter plate, the resilient disc overlapping the hard disc to engage coins adjacent the perimeter of the hard disc and to move the coins to and along the track; and a flexible deflector plate extending from the inside of the hopper toward the edge of the raised portion in advance of the resilient disc, said deflector plate terminating at a distance from the edge that is less than twice the diameter of the smallest coin to be sorted.

* * * * *